United States Patent [19]

Henry

[11] 4,170,061

[45] Oct. 9, 1979

[54] LOCKING MECHANISM FOR FOLDING POCKET KNIFE

[76] Inventor: Daniel E. Henry, Mountain Ranch, Calif. 95246

[21] Appl. No.: 914,189

[22] Filed: Jun. 12, 1978

[51] Int. Cl.[2] ..... B26B 1/04

[52] U.S. Cl. ..... 30/160

[58] Field of Search ..... 30/160, 161

[56] References Cited

U.S. PATENT DOCUMENTS

| | | | |
|---|---|---|---|
| 603,847 | 5/1898 | Harvey | 30/161 |
| 1,357,398 | 11/1920 | Haywood | 30/161 |
| 2,304,601 | 12/1942 | Schrade | 30/160 X |
| 3,942,249 | 3/1976 | Poehlmann | 30/161 X |
| 4,120,088 | 10/1978 | Phelps | 30/160 |

FOREIGN PATENT DOCUMENTS

| | | | |
|---|---|---|---|
| 549428 | 11/1942 | United Kingdom | 30/160 |

*Primary Examiner*—Jimmy C. Peters

*Attorney, Agent, or Firm*—Flehr, Hohbach, Test, Albritton & Herbert

[57] ABSTRACT

The folding pocket knife disclosed herein provides an adequate sizing skinning blade for big game, etc., with the capability of being safely locked whether in the open position for use or in the folded position for carrying, providing the maximum overall length of cutting edge but providing a more compact and convenient size for carrying in one's pocket or on one's person.

5 Claims, 5 Drawing Figures

LOCKING MECHANISM FOR FOLDING POCKET KNIFE

BACKGROUND OF THE INVENTION

Cutting knives have a very ancient and long continuous history. A cutting edge has been traced back to the Stone Age when hard rock was sharpened to a fine edge for cutting and scraping and later this concept developed into a metal implement with a sharp cutting edge. In the course of this history there have been continuous developments right up to the present time. Obviously any invention at this time must be played against this vast chain of development and must be significant in order to be useful.

Possibly the three most important considerations in knife development are safety, balance and convenience. All of these must include esthetics, as an ugly or awkward instrument presenting any difficulty would be useless and unsalable.

Amongst the most recent art which has developed with respect to knives includes the U.S. Patent to Paul W. Poehlmann, No. 3,942,249, which issued Mar. 9, 1976. While the knife described and disclosed therein had the germ of a useful improvement, the form described and disclosed in the patent is utterly incapable of being manufactured reasonably and competitively as it has built in inherent characteristics which doom the structure to mechanical failure. It is difficult to operate and is dependent upon springs which are notorious bad actors so far as reliability and calculated life are concerned.

In order for a knife to be useful it must possess certain advantages. One of these advantages is that it must be capable of commercial manufacture using standard tooling which are not only easily available but are the ordinarily used tools of a competent metalworker. No special or exotic tooling or machinery should be required for the manufacture.

It should operate using a familiar conventional technique to open and close the knife, so that the user does not have to learn a new technique or knack of performing this simple operation.

Because of the unreliability of springs, whether coil or leaf, and the lack of uniformity of performance, the use of springs should be eliminated. However, a relatively heavy pressure of 12 to 14 psi should be provided for the release of any locked position of the blade to prevent any chance of accidentally unlocking the blade whether in the open or closed position.

In releasing the lock holding the position of the blade, only a minumum movement of the release mechanism should be required.

A locking mechanism should provide a minimum overall size to allow for the most compact design of the knife. The release and locking mechanism should be small enough so that it can be standardized for use in the greatest number of knife sizes, without reducing or enlarging the basic size of the mechanism.

The moving parts in the mechanism with the exception of the plunger head should be concealed from any outward view, not only for the purpose of esthetics but for the very practical reason of insuring against the entry of dirt and contaminants which would interfere with the safe operation of the locking mechanism.

The matching slots in the blade and liner which can be planned in any position in a plane, so long as they are aligned with each other.

Obviously the blade must be capable of being locked in both the closed and open positions.

A very important maintenance object is, if the blade loosens from excessive wear, the lateral play will be easily eliminated by tightening the lock ring. If necessary the lock ring can be fixed in position with the material known as Loctite. However, since it is not subjected to any motion, mechanical locking of the ring is not necessary.

In order to reduce any likelihood of wear both the locking bar and blade must be of the same type steel and Rockwell hardness.

Another feature which is an objective is to provide a knife which is quieter and does not make any loud "click" when moved from the closed to the open position as is true with practically all knives of this character.

Design features of the knife are important in limiting the rotating parts to one, which is the blade, and two movable parts to two the plunger assembly and the locking bar.

The elimination of spring pressure on the blade which must be overcome when opening, does away with the necessity for the thumb nail nick, and the absence of spring pressure against the blade results in greater leverage allowing tighter or closer fits in the entire construction.

A little known advantage is attained by the structure herein in the elimination of the flat area of the blade between the bevel and the handle where the trademark is usually stamped into the metal, called the "ricasso". This also provides the greatest operative length for the cutting edge resulting in a stronger and more usable blade, and improves the esthetic characteristics of the entire knife.

It is a further object of this invention to cut down the maximum thickness through the bolsters, resulting in a much thinner or flatter knife than that of conventional and comparable knives.

All of these are the advantages and objectives attained by the structure disclosed herein.

Further objects are to provide a construction of maximum simplicity, economy and ease of assembly and disassembly, also such further objects, advantages and capabilities as will fully appear and as are inherently possessed by the device and invention described herein.

The invention further resides in the combination, construction and arrangement of parts illustrated in the accompanying drawings, and while there is shown therein a preferred embodiment thereof, it is to be understood that the same is illustrative of the invention and that the invention is capable of modification and change and comprehends other details of construction without departing from the spirit thereof or the scope of the appended claims.

DESCRIPTION OF THE PREFERRED EMBODIMENTS

Figure 1:
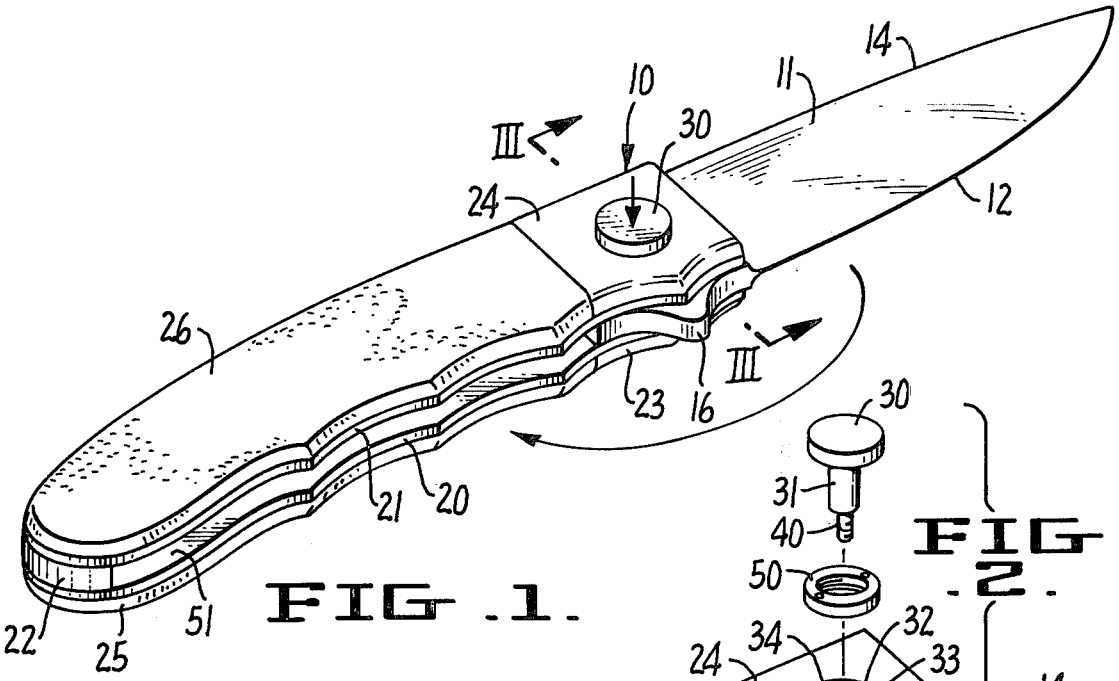
FIG. 1 is a perspective view of the knife disclosed herein, showing the blade in the open position.

Referring now more particularly to the drawings in which like numerals indicate like parts in the several views, the knife of the invention is designated 10. Aside from the locking members, the parts of this knife are few in number. The blade 11 has a cutting edge 12, a back 14, the tang 15, a safety guard 16, a through hole 17 with communicating opposed square slots 18. There are two liners 20 and 21 which are spaced from each other along the backside by a spacer 22, which is secured both to liners 20 and 21. There are right and left bolsters 23 and 24 respectively, and right and left scales 25 and 26 respectively. The scales are attached by concealed pins (not shown) and as these form the handle or grip, there is nothing to work loose or cut into the hands and fingers of the user.

Figure 2:
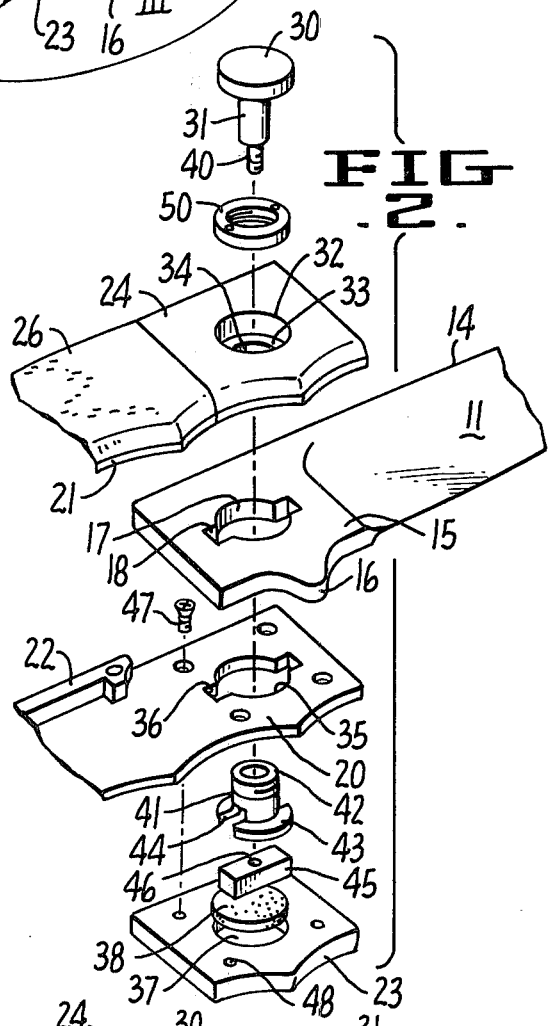
FIG. 2 is an exploded view of the locking mechanism.
Figure 4:
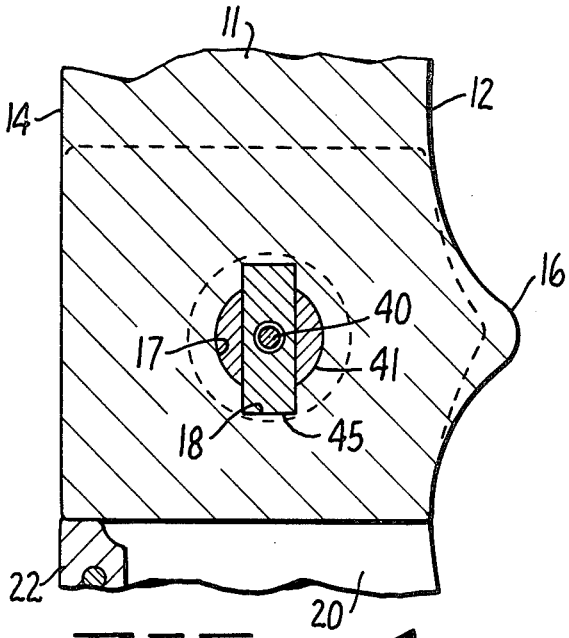
FIG. 4 is a plan view taken on the line IV—IV of FIG. 3, showing the locking mechanism in the closed or locked position
Figure 3:
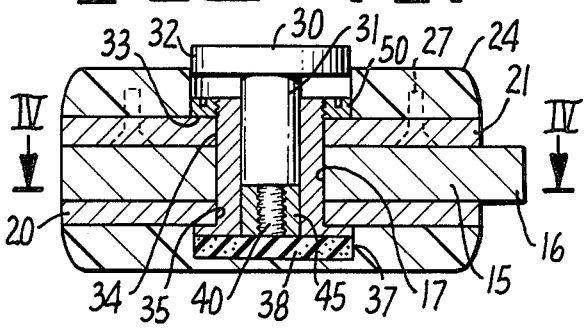
FIG. 3 is a transverse section on an enlarged scale taken on the line III—III of FIG. 1.
Figure 5:
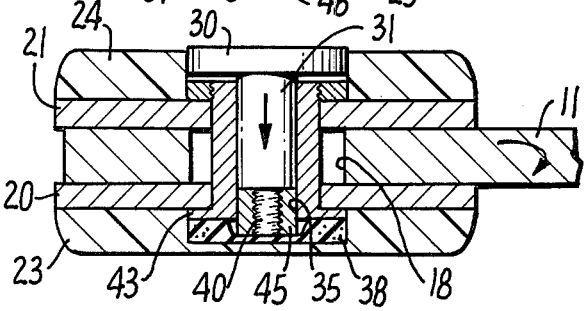
FIG. 5 is a view similar to FIG. 3 but showing the locking mechanism depressed to release the locking bar and allow movement of the blade.

Referring now to FIG. 2 more particularly, and also to FIGS. 3 and 5, the locking mechanism is shown in exploded form and in the manner in which it is assembled. It will be noted that the bolster 24 is secured in position on the liner 21 by small standard Phillips screws 27, which do not become visible externally, thus permitting the trademark or name to be applied to the metal without structural weakness to the knife or interference with its use. The bolster 24 is drilled through on a diameter which comfortably seats the head 30 of the plunger 31. This through hole is 32. The liner 21 is bored on a smaller diameter axially therewith providing a seat or ledge 33. The cylinder 31 of the plunger is smaller in diameter than the hole 34 and passes therethrough.

As indicated earlier, the full thickness of the blade known as tang 15 is covered by the bolster 24, has a through hole 17 therein of the same diameter as the hole 33 and in axial register therewith. As shown in the drawings, the hole 17 has two open in-line squared slots 18 exactly 180° from each other. The liner 20 is bored with a hole 35 which exactly coincides with the hole 17 of the blade and also squared slots 36 which are identical and register with the slots 18, in line therewith. In the bolster 23 on the interior surface thereof, a counterbore 37 is provided slightly larger in size than holes 17 and 35, and extends a short distance into the bolster. Into this hole is secured a resilient substance 38, such as Neoprene, which has the compression resistance capability of about 12–14 psi with memory for return to the uncompressed state.

The plunger assembly 31 has a threaded portion 40 of smaller diameter which will be explained later. A cylindrical sleeve member 41 is threaded externally at its upper end 42, and is adapted to slide in the openings 35 and 17. At the bottom portion of member 41 is a flange 43 which bears against and retains the resilient member 38 in its socket 37 within the bolster 23. A transverse axial slot 44 is cut diametrically through the flange and cylinder 43 and 41 respectively, sufficient to receive a metallic locking bar 45 which rides in the slots 18 and 36 in a manner hereinafter described. The plunger 31 slides within the cylinder 41 and the threaded portion 40 of the plunger 31 engages the threaded hole 46 of the locking bar 45, making this assembly operate as a unit.

The locking assembly is held in position from the outside by the bolster 23 which is secured to the liner 20 by screws 47 passing through the liner 20 and secured in the bolster in threaded holes 48. In this manner no screws are visible from the outside whatever and no chance of the entry of dirt or other contaminants are possible from this side. The entire assembly including bolster 24 is secured in position by lock ring 50, which is internally threaded to engage the upper threads 42 of the cylindrical member 41, and bear against the flange 33 to tighten the assembly in position.

In the locked position, the locking bar 45 in the locked position shown in FIG. 3 projects into the slots 18 of the blade 11 approximately 0.040" above the inner surface of the liner 20. As is demonstrated in FIG. 5, upon dpression of the locking assembly downwardly against the resilient material 38, the locking bar 45 will move to unlock the blade and permit it to be moved from the open or closed position, to the opposite position.

The guard 16 projecting from the tang portion 15 is an important safety measure to stop movement of the fingers on to the cutting edge of the blade in the open position.

It is to be observed that no portion of the locking means rotates. The plunger moves reciprocally approximately 0.040" and this is the only movement involved. Once the locking bar is disengaged, the blade is rotated manually from either the closed to the open position or vice versa.

OPERATION

Assuming the closed position of the knife 10 with the blade 11 and its cutting edge 12 sheathed within the space 51 provided by the spacer 22, the knife blade is in the locked position shown in FIG. 3. This is the normal carrying position for the knife. The blade cannot be moved out of the sheathed position as the bar 45 projects above the liner 20 and into the square slots 18 of the knife blade 11. In order to open the knife all that is necessary to be done is to press downwardly on the head 30 and the plunger 31 moves downwardly within the cylinder 41 causing the bar 45 to move downwardly against the resilient material 38 clearing the bar from projection into the square slots 18 of the blade while guiding in the square slots 36 of the liner 20 and also within the slot 44 of the cylindrical member 41 as shown in FIG. 5. There is nothing visible from the outside and there is no way for outside contaminants to enter into the mechanism. Once the engagement of the bar 45 is released from slots 18, the knife is easily moved 180° to the open position shown in FIG. 1. Immediately the bar 45 engages the slots 18 of the blade and it is locked in the open position shown in FIG. 1 and ready for use.

As indicated earlier, the open position gives the maximum use of the blade edge 12 by the elimination of any exposed ricasso. It is apparent that all of the objectives as set forth herein and more, are achieved by this safe, beautifully styled and balanced knife.

I claim:

1. A folding knife with a locking mechanism for locking the same in the open and in the closed positions, said knife having a blade with ricasso and a cutting edge and a handle for receiving the blade and cutting edge when in the closed position, said handle comprising a pair of liners at either side of the blade, spaced apart a sufficient distance along the inner edge by a spacer to provide a protected housing for the blade in the closed position, a pair of bolsters and scales overlaying the outer surfaces of each liner, a transverse axial line passing through the bolsters, liners and blade which represents the pivot of the blade from the open to the closed positions and vice versa, said bolster on one side having a through bore and the opposite bolster having an inner counterbore of substantially the same diameter forming a well axially aligned with said pivot, through bores similarly aligned but of smaller diameter in the liners and the blade each with identical radially extending squared slots exactly 180° from each other and in axial registry, the locking means comprising a depressible plunger removably secured within said through bores having a bottom slot for receiving and axially guiding a pressure bar, a pressure bar, a resilient member in said well bearing against said pressure bar allowing limited axial movement, said pressure bar also guiding in said square slots in a locked position and released from engagement with the blade slots to permit rotation from the open to the closed positions, or vice versa, by axial pressure against the resilient member.

2. The knife and locking means of claim 1 wherein the pressure means is a plunger provided with a button-like head which projects slightly above the outer surface of the bolster and freely guides in the through bore of the said bolster for operation by external pressure.

3. The knife and locking means of claim 2 wherein the ricasso of the blade is completely covered by the liners and bolsters, providing maximum length and use for the cutting edge of said blade.

4. The knife and locking means of claim 2 wherein the ricasso of the said blade in the open position has a lateral protective projection, which is concealed in the closed position, to prevent inadvertent movement of the hand or fingers to the cutting edge of said blade.

5. The knife and locking means of claim 2 wherein the resilient member resists a compression up to 12 to 14 psi for release and has a memory for returning the compression bar to its normal uncompressed state immediately upon release of the external pressure.

* * * * *

UNITED STATES PATENT AND TRADEMARK OFFICE

CERTIFICATE OF CORRECTION

PATENT NO. : 4,170,061

DATED : October 9, 1979

INVENTOR(S) : Daniel E. Henry

It is certified that error appears in the above—identified patent and that said Letters Patent is hereby corrected as shown below:

Column 1, delete lines 22 through 33.

Signed and Sealed this

*Seventh* Day of *April 1981*

[SEAL]

*Attest:*

RENE D. TEGTMEYER

*Attesting Officer*

*Acting Commissioner of Patents and Trademarks*